US011661303B2

(12) United States Patent
Wyseur et al.

(10) Patent No.: US 11,661,303 B2
(45) Date of Patent: May 30, 2023

(54) YARN STORAGE DEVICE FOR A YARN PROCESSING MACHINE

(71) Applicant: VANDEWIELE NV, Kortrijk (BE)

(72) Inventors: Karl Wyseur, Kortrijk (BE); Vincent Lampaert, Vichte (BE); Koen Bruynoghe, De Pinte (BE); Dominique Maes, Dentergem (BE)

(73) Assignee: VANDEWIELE NV, Kortrijk (BE)

( * ) Notice: Subject to any disclaimer, the term of this patent is extended or adjusted under 35 U.S.C. 154(b) by 243 days.

(21) Appl. No.: 17/253,171

(22) PCT Filed: Jun. 19, 2019

(86) PCT No.: PCT/IB2019/055165

§ 371 (c)(1),
(2) Date: Dec. 17, 2020

(87) PCT Pub. No.: WO2019/244071

PCT Pub. Date: Dec. 26, 2019

(65) Prior Publication Data

US 2021/0276821 A1 Sep. 9, 2021

(30) Foreign Application Priority Data

Jun. 20, 2018 (BE) ..... 2018/0074

(51) Int. Cl.
*B65H 51/22* (2006.01)
*B65H 49/16* (2006.01)
*D02H 1/00* (2006.01)

(52) U.S. Cl.
CPC ..... *B65H 51/22* (2013.01); *B65H 49/16* (2013.01); *D02H 1/00* (2013.01); *B65H 2701/31* (2013.01)

(58) Field of Classification Search
CPC .... B65H 51/22; B65H 49/16; B65H 2701/31; D02H 1/00
See application file for complete search history.

(56) References Cited

U.S. PATENT DOCUMENTS 3,921,925 A 11/1975 Sarfati et al.
9,487,887 B1 11/2016 Grossman

FOREIGN PATENT DOCUMENTS

DE 1903133 B1 1/1970
EP 2721204 A2 4/2014

OTHER PUBLICATIONS

Search Report for International Patent Application PCT/IB2019/055165, dated Dec. 26, 2019.

*Primary Examiner* — William E Dondero
(74) *Attorney, Agent, or Firm* — Fresh IP PLC; Clifford D. Hyra; Aubrey Y. Chen

(57) ABSTRACT

The present invention relates to a yarn storage device for a yarn processing machine, a method for supplementing a yarn store in said yarn storage device and a yarn processing machine provided with said yarn storage device, wherein the yarn storage device comprises storage units (2, 7) and loading means (3) in order to add yarn in a selected storage unit, wherein at least one storage unit comprises a winding holder (7) that is provided to keep a yarn store in a state wound round a holder body (7*c*), and wherein preferably yarn is added in windings with a winding diameter ($D_1$) that is greater than the radial dimensions ($D_3$) of the holder body (7*c*).

20 Claims, 6 Drawing Sheets

YARN STORAGE DEVICE FOR A YARN PROCESSING MACHINE

Figure 1:
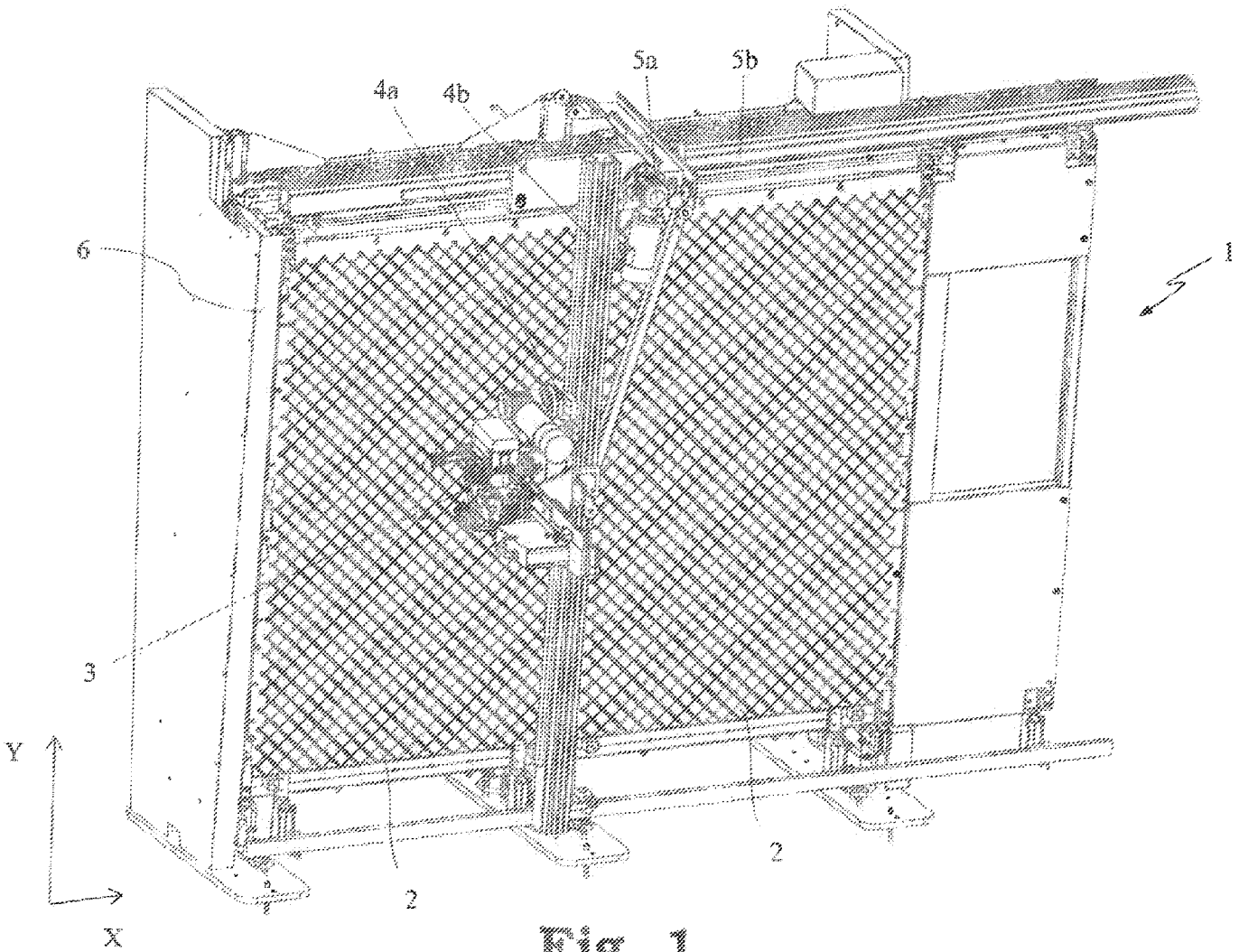

The present invention relates to a yarn storage device for a yarn processing machine comprising at least two storage units that are provided in order to comprise a respective yarn store for the yarn processing machine, and loading means that are provided in order to join an end of the yarn from a selected storage unit to an end of an external amount of yarn and to add yarn from the external amount of yarn to the yarn from the selected storage unit.

The present invention further relates to a yarn processing machine, in particular a weaving machine, provided with at least one such yarn storage device. Each type of weaving machine is regarded as a yarn processing machine, such as, among others, a double-face weaving machine, a wire weaving machine, an Axminster weaving machine, a loop pile weaving machine and a weaving machine for weaving flat fabrics. However, among others, knitting machines (both warp knitting machines and weft knitting machines) and beaming machines are regarded as a yarn processing machine herein.

The present invention also relates to a method for replenishing a yarn store for a yarn processing machine, wherein at least two storage units are provided, which comprise a respective yarn store for the yarn processing machine, wherein a selected yarn store is supplemented by joining an end of said selected yarn store to an end of an external amount of yarn and wherein yarn from the external yarn store is added to the selected yarn store.

In multicolour weaving and tufting of carpet, pile warp yarns of different colours must be supplied to the weaving or tufting device. The consumption of these pile warp yarns depends on the design of the carpet and therefore is not usually uniform and is not identical for each pile warp yarn in the fabric. The yarn storage device must thus comprise an individual yarn store for each different pile warp yarn. It is known to achieve this by supplying the different yarns from respective bobbins that are placed in a bobbin creel.

This bobbin creel must often comprise many thousands of bobbins and consequently takes up a lot of space, and the total amount of yarn in such a bobbin creel is also considerable. Replenishing of yarns in the bobbin creel and changing yarns for weaving machines or tufting machines is to this date still often done manually. This takes up a lot of time, so that the machine is unproductive for a long time. This is very detrimental for the overall profitability of the weaving machine. In addition, this work represents a considerable labour cost.

European patent EP 0 422 093 describes a yarn storage device consisting of a number of yarn storage units, installed next to one another, in the form of elongated tubes in which yarn is stored in the wound-up state. Each of these tubes has an open entry side via which yarn is added to the yarn store and an open outlet side via which the yarn leaves the tube and is led to a yarn processing machine. The yarn loader is provided to be positioned on the entry side of a selected tube in order to supplement the supply of yarn in said tube with the desired yarn. Supplementing is possible without interrupting the fabric production process since new yarn can be added by joining (by knotting or splicing) the free end of the yarn to be added, to the free end of the yarn store present in the tube.

After the joining of the yarn ends, supplementing takes place by forming yarn windings in the tube by means of a rotating head. The new windings push the yarn store already present forwards in the tube.

It has been seen in practice that this manner of making windings is not suitable for every type of yarn. It is only with yarns with sufficient stiffness and roughness that the windings keep their shape, so that the windings join together without risk of tangling. For yarns that have limited stiffness in themselves, or are smoother with respect to structure, this method does not offer a solution, because the windings are not well formed or because the windings do not join together well, so that during extraction, knots and/or tangles are formed on the outlet side of the tube, and these can no longer be unravelled.

In another known yarn storage device, described in European patent EP 2721204 from the same applicant as the present patent application, the yarn loader is provided first to wind up the yarn to be added on a winding-up body and then to remove it in the wound-up state from the winding-up body and add it into the yarn storage space.

Although this solution gave a considerable improvement, it was found that with certain yarn types the risk was still too great that the yarn windings in the yarn storage spaces would lose their ideal shape or would not join together well and fall apart so that these unstable windings cause tangling of the yarn.

The aim of the present invention is to overcome this drawback by providing a yarn storage device for a yarn processing machine and a method for replenishing a yarn store for a yarn processing machine, which make it possible to automate, for a large number of different yarn types, the time-consuming and labour-intensive activities in the bobbin creel in a way that further reduces the risk of tangling of the yarn.

These aims are achieved by providing a yarn storage device with the features stated in the first paragraph of this description, wherein, according to the present invention, at least one storage unit comprises a winding holder with a holder body that is provided in order to the keep the windings of a yarn store in a state wound round this holder body.

The winding holder ensures that the windings are held in a stable form. Preferably, the windings are held as successive windings placed one after another in the state wound round the holder body. The successive windings preferably fit closely against each other. The successive windings are preferably also not overlapping.

The stated aims are also achieved by providing a yarn processing machine that is provided with at least one yarn storage device according to the invention. Said yarn processing machine is preferably a weaving machine, a tufting machine, a knitting machine or a beaming machine.

The above aims are also achieved by providing a method with the features presented in the third paragraph of this description, wherein in at least one storage unit, a winding holder with a winding body is provided, and wherein each yarn store is held in a state wound round the winding body. This method according to the invention preferably has the distinctive features according to one or more embodiments described herein.

In a preferred embodiment of the yarn storage device according to the present invention, the holder body of at least one winding holder defines a holder surface for the windings, and the associated storage unit comprises guiding means for leading away the yarn of the yarn store from the yarn storage unit during unwinding thereof from the holder surface.

The holder body may have an open structure and may have an angular external form. It may for example consist of fingers that are arranged according to an angular, preferably polygonal, configuration and wherein the space between these fingers is open. The yarn windings may be carried by these fingers and be moved over them. The holder surface is then the surface that is defined by the fingers, wherein the fingers are considered to be connected together by a virtual surface. In a preferred embodiment, the holder body is an elongated cylindrical element that has a substantially equal diameter over its whole length and the holder surface is a substantially closed cylindrical surface. The holder body has for example a radial dimension of about 25 mm.

The guiding means are preferably provided for unwinding the yarn from the holder surface with an unwinding diameter that is greater than the radial dimensions of the holder body.

Said guiding means may comprise a guiding surface for the yarn or a feed-through element, such as a feed-through eye or a feed-through tube, through which the yarn is led during unwinding thereof, so that unwinding takes place with an unwinding diameter that is greater than the radial dimensions of the holder body. The guiding surface or the feed-through element thereby determines an unwinding path for the yarn by which the yarn is led away from the holder surface.

When the guiding means comprise a guiding surface, this guiding surface is preferably located at a radial distance relative to the longitudinal axis of the holder body that is greater than the radial dimension of the holder body. The guiding surface may be formed by a component of the winding holder or an individual element that interacts with the winding holder, wherein the outer surface of that component or element is located, relative to the longitudinal axis of the holder body, at a larger radial distance than the holder surface. This outer surface then forms said guiding surface. This is inter alia the case with the further described embodiment of a winding holder provided with an unwinding head.

The tubular element is preferably configured so that it does not form any corners or bends with an angle that is greater than 60°, preferably not greater than 45°. This angle is preferably less than or equal to 30°. Bends or angle-forming parts that describe an angle of about 20° are the most preferred.

The position of the entrance of the tubular element then determines the first part of the unwinding path of the yarn. The same applies to the position of a feed-through eye. The entrance of the tubular element or the feed-through eye is preferably located at a radial distance relative to the longitudinal axis of the holder body that is greater than the radial dimension of the holder body, so that the yarn is led away from the holder surface.

The tubular element or the feed-through eye is preferably rotatable about a rotation axis that almost coincides with, or lies in the extension of the longitudinal axis of the holder body. For this purpose, the tubular element or the feed-through eye is for example fastened on a shaft that is mounted rotatably and preferably is mounted on bearings. Thus, the tubular element or the feed-through eye may, during unwinding of yarn, describe a turning circle about the rotation axis, wherein the diameter of this turning circle is greater than the radial dimension of the holder body.

Because the angle-forming parts or bends of the tubular element describe an angle that is at most 60°, a good force effect is obtained, so that the tubular element rotates as a result of the force exerted thereon by the yarn, wherein the build-up of stress in the yarn itself can be kept very small. The rotating motion of the tubular element is preferably easily obtained by the forces that the yarn exerts thereon during the unwinding and movement thereof to the yarn processing machine. An embodiment wherein the rotating motion of the tubular element is obtained with a driving means, for example an electric motor, is however also possible.

These measures ensure that the yarn windings on the holder body are not pulled tight, and can be unwound from the holder body very gradually one at a time with a small force.

To increase the efficiency of the unwinding process even further, both a guiding surface and a feed-through element may be provided, for example an unwinding head with larger radial dimensions than the holder body in combination with a rotatably mounted tubular element in order to lead the yarn revolving, as is the case in a preferred embodiment described in more detail.

In a particularly preferred embodiment, the guiding means comprise an unwinding head connected to the holder body, having radial dimensions greater than the radial dimensions of the holder body.

These radial dimensions may remain the same over the length of the unwinding head, but they may also vary. The yarn may, during unwinding thereof, come into contact with the surface of the unwinding head and is thus led away from the holder surface of the holder body, as already stated above.

The unwinding head preferably has a certain length, in order to be able to support the winding holder at the level of the unwinding head. Even more preferably, the unwinding head has maximum radial dimensions for at least part of this length. In this way, the surface of the unwinding head can also ensure that if more than one winding should unintentionally go beyond the barrier formed by the unwinding head, these surplus windings can then remain on the surface of the unwinding head awaiting unwinding thereof, so that mutual entangling of yarn windings is prevented.

In a properly functioning yarn storage device, at least one winding holder comprises a transition part with a first end abutted to the holder body with radial dimensions almost the same as the radial dimensions of the holder body, and a second end facing said guiding means with radial dimensions almost the same as the unwinding diameter, and the radial dimensions of the transition part gradually increase from the first end to the second end.

Because of this, a gentle braking action can be exerted on the yarn windings. The holder body is preferably also connected to said guiding means via the transition part.

If the yarn has to cross a projection or a barrier, a larger force would have to be exerted to get the yarn over this barrier. The chance of this then causing more than one winding to be pulled over the barrier at the same time is therefore greater, increasing the chance of tangling of the yarn. The gentle braking action is thus important for efficient unwinding of the windings gradually one by one, without this requiring large forces.

In an embodiment of the yarn storage device wherein the holder body is connected to an unwinding head, the holder body is connected to the unwinding head via the transition part.

Moreover, it is very preferable to configure the winding holder so that, viewed in a vertical cross-section of the holder body, a first line that extends in the extension of the upper side of the transition part and a second line that extends in the extension of the upper side of the holder body enclose an angle (a) that is not greater than 60°, preferably not greater than 45°, wherein this angle (a) even more preferably is greater than or equal to 10° and is less than or equal to 30°, and most preferably is about 20°.

This gives an ideal gentle braking action on the yarn windings. If the angle (α) is greater than 60°, a kind of shoulder is anyway formed that requires an excessive force on the yarn to get the yarn past the shoulder and unwind it further. On the one hand, this would give rise to a higher yarn tension and increase the chance of yarn breakage, and on the other hand, the force required for unwinding the yarns would still be too great to prevent more than one winding getting past the shoulder at the same time, in all circumstances, and with all yarn types.

Preferably, the loading means are provided in order to add yarn from the external amount of yarn to the yarn from the selected storage unit in windings with a winding diameter that is greater than the radial dimensions of the holder body.

Even more preferably, at least one storage unit comprises guiding means that are provided in order to unwind the yarn from the holder body with an unwinding diameter that is greater than the radial dimensions of the holder body, and the ratio of the unwinding diameter to the winding diameter is between 0.98 and 2, preferably between 0.99 and 2, more preferably between 0.99 and 1.5, even more preferably between 1 and 1.25 and even more preferably between 1 and 1.1, wherein the indicated limit values are always included. In a highly preferred embodiment, this ratio is roughly equal to 1.

Even more preferably, at least one winding holder comprises a winding-up part connected to the holder body, the loading means are provided to add yarn from the external amount of yarn to the yarn from the selected storage unit by winding it onto the winding-up part of the corresponding winding holder, wherein the windings on the winding-up part are gradually moved towards the holder body, and the winding-up part has radial dimensions that are greater than the radial dimensions of the holder body.

The windings are preferably placed as successive windings one after another, wound up on the winding-up part.

The yarn store is in the form of windings held on the holder body, wherein the winding diameter of these windings roughly matches the radial dimension of the winding-up part. If the radial dimensions of the unwinding head and the winding-up part are only slightly different from one another, the windings, which are not in a perfectly perpendicular position on the holder body, are retained by the unwinding head, whereas the barrier that these windings must cross when being unwound is barely, if at all, greater than their own winding diameter. As a result, during unwinding, the yarn can be pulled with very small forces past the unwinding head.

In a preferred embodiment the windings that are on the winding-up part are gradually displaced towards the holder body by the newly added windings until they are on the holder body. The loading means then simply ensure that the yarn is held firmly. In an alternative embodiment, the loading means may be provided for moving the yarn on the winding-up part towards the holder body.

In this patent application, "radial dimension(s) of a component" means the largest radial dimension of the component in question. If the component in question is cylindrical, it is of course the diameter of the component in question.

In this patent application, reference is made to the winding diameter and the diameter of the windings, on the assumption that these windings have a circular course. It is obvious that in the case when the shape of one or more or all of the windings is not circular, these terms refer to the largest radial dimension of these windings.

Owing to the larger radial dimensions of the winding-up part, yarn windings are formed with a winding diameter that is greater than the radial dimension of the holder body. While retaining this larger winding diameter, these windings arrive on the holder body and as a result, they are wound round the holder body in a very loose state. Therefore there is only minimal contact between the yarn and the holder surface. The yarn windings can thus be moved in the longitudinal direction of the holder body very easily by small forces. This of course is beneficial for the stability of the yarn windings, so that the risk of tangling of the yarn during unwinding thereof is greatly reduced for all yarn types.

The transition between the diameter of the winding-up part, for example 35 mm, and the diameter of the holder body, for example 25 mm, may be gradual, over a relatively large distance, or may also take place over quite a short distance.

The winding-up part does not necessarily have a closed structure. It may also consist of a number of elongated winding-up elements with an open space in between, wherein the winding-up elements are mounted according to an angular configuration. The winding-up body is also not necessarily cylindrical. The radial dimension of the winding-up part is for example about 35 mm.

In a particular embodiment at least one winding holder is included in a respective yarn storage space with a supply opening, and movable between a position of rest wherein the winding-up part is largely located within the yarn storage space of the storage unit and a winding-up position wherein the winding holder extends via the supply opening to outside the yarn storage space and wherein the winding-up part is largely located outside the yarn storage space, and the yarn storage device is provided for bringing the winding holder from a selected storage unit into the winding-up position.

Because the winding-up part is largely located outside the yarn storage space during winding-up of yarn, there is sufficient space for quick, fully automated winding-up, for example by means of a yarn loader. For example, a yarn loader as described in European patent EP 2721204 is used for this. For the winding holder to be mounted movably, use may also be made of an attachment that is fitted at the level of the supply opening to the yarn storage tube or to an open carrying structure, and to which the winding holder can be secured slidably in the axial direction. A 'fixed piece' of this kind was presented in EP 2721204, referring to FIG. 14 of that patent.

Said storage space is not necessarily a closed space. The winding holders of the yarn storage device according to the present invention may also be fastened to an open carrying structure, wherein each winding holder is carried or supported by a number of carrying elements of this open carrying structure that are located in the vicinity of the winding holder, and wherein a space within this open carrying structure is provided for each winding holder. The yarn storage space is then the free space around each winding holder between the carrying elements. The carrying structure could for example consist of two grids that extend in parallel planes, wherein the winding-up part of each winding holder is fitted on one grid and the means for supporting the guiding elements, optionally contactless, are fitted on the other grid. However, each winding holder is preferably mounted in a respective tubular element with substantially closed sidewalls and two open ends.

In a possible embodiment, the windings are also supported at least partially by the walls or carrying elements of the storage space. Preferably, the windings are then supported on a wall of the yarn storage space. There is then less load on the winding holder from the weight of the yarn windings, with the result that for supporting the winding holder, less attention has to be paid to the difference in load between a winding holder whose holder body carries hardly any yarn windings and a winding holder whose holder body carries yarn windings over almost the entire length.

In another particular embodiment at least one storage unit comprises guiding means that are provided in order to unwind the yarn from the holder body and a winding holder that is contained in a respective yarn storage space with a discharge opening via which the yarn is displaced towards the yarn processing machine, and the winding holder extends in the position of rest via the discharge opening to outside the yarn storage space, so that the guiding means are located at least partially outside the yarn storage space.

Because the guiding means are located at least partially outside the yarn storage space during unwinding of yarn, the yarns can be unwound unhampered by tubular walls or carrying structures.

However, wind-up of yarn round the winding-up part of a winding holder of a yarn storage unit is no obstacle to supply the yarn from this yarn storage space in the meantime to the yarn processing machine. Even in the winding-up position, space is provided between the guiding means (e.g. the unwinding head) and the tubular wall or carrying structures to allow the yarn to pass.

It is also best if the winding holders are supported in a fixed and stable operating position. Therefore, it is preferable for at least one storage unit to be supported by means of one or more flexible and/or deformable and/or movable supporting elements.

These may for example be flexible elements such as flexible plates or hairs etc., but also for example rotatably fastened elements that are movable by rotation thereof. Each supporting element is then placed so that at least some supporting elements come in contact with the yarn during unwinding of the yarn, and so that the supporting elements are bent and/or deformed and/or moved by the forces that are exerted thereon by the yarn directly or indirectly (through contact with other supporting elements that are deformed and/or bent and/or moved by the yarn), and so allow the yarn to pass through.

The aforementioned supporting may also, or additionally, be realized in that at least one storage unit comprises one or more force means that are provided in order to exert a contactless force on the winding holder, so that the winding holder is forced by this force (these forces) without contact to a predetermined operating position.

These force elements are for example magnets. By providing on the one hand the winding holder and on the other hand the structures that are in the vicinity thereof, with magnets with mutually repulsive poles, the repulsive forces can ensure precise and permanent positioning of the winding holder. Because these magnetic forces are developed without any contact with the winding holder, the space round the winding holder remains free and the yarn cannot be hampered during movement thereof on the holder body and during unwinding thereof.

In a particular embodiment, at least one storage unit comprises guiding means for leading the yarn of the yarn store away from the holder surface during unwinding thereof, and the winding holder and the guiding means are supported by a common rotatable shaft. The guiding means are then preferably rotatable together with the rotation axis about an axis that coincides with, or lies in the extension of, the longitudinal axis of the winding holder.

The invention is now explained in more detail on the basis of the more detailed description given hereunder of a number of possible embodiments of important components and parts of a yarn storage device according to the present invention. The embodiments described are only examples and therefore the description thereof cannot in any way be interpreted as a limitation of the scope of protection, nor of the field of application of the invention.

Figure 2:
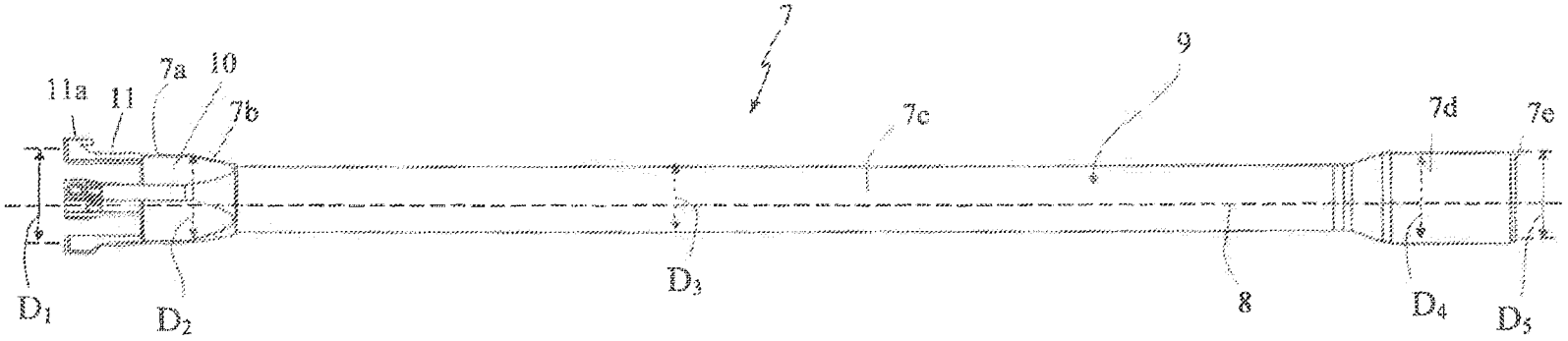
Figure 3:
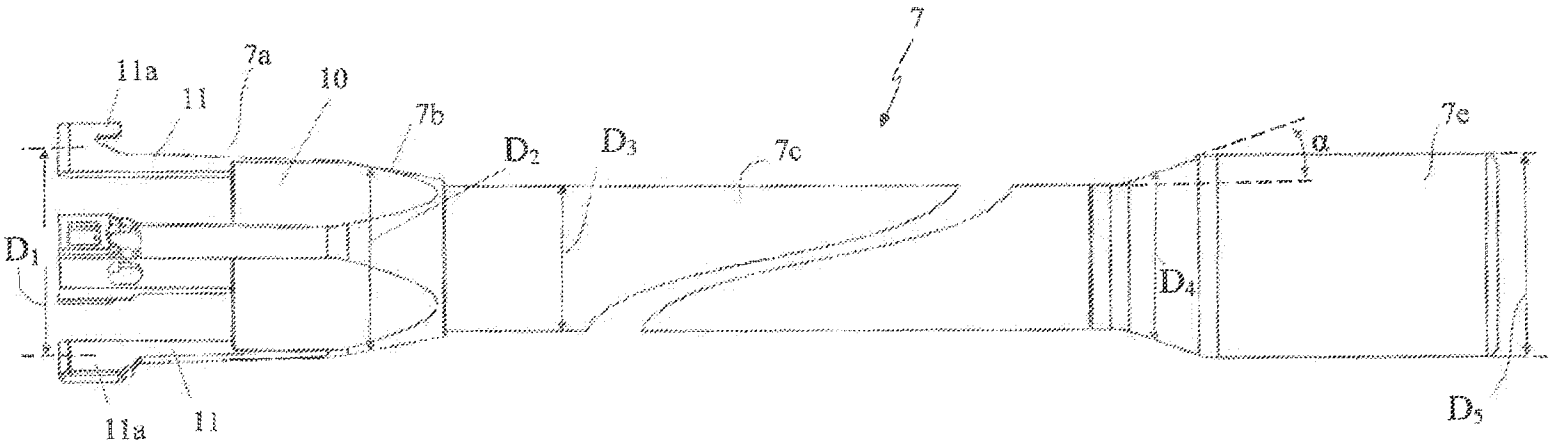
Figure 5:
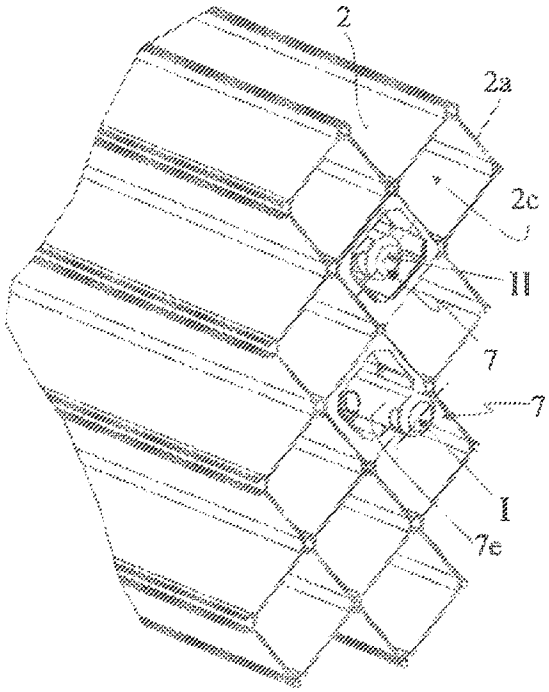
Figure 4:
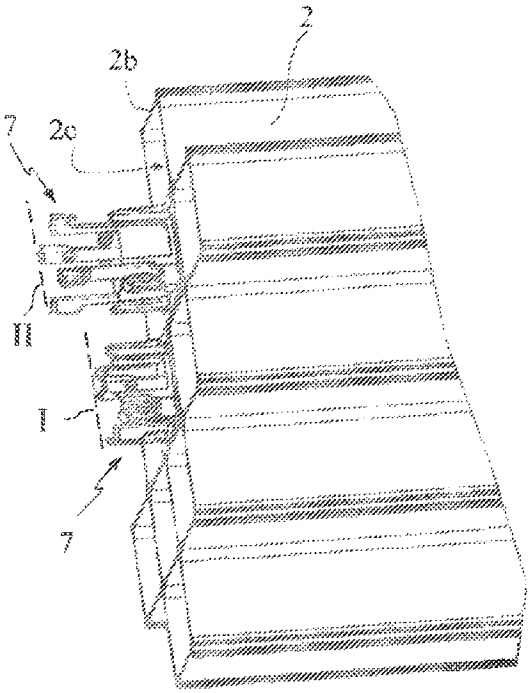

In this detailed description, reference numbers are used for referring to the appended figures, where FIG. 1 is a perspective view of a yarn storage device according to the invention, FIG. 2 shows a side view of a winding holder of the yarn storage device according to the invention, FIG. 3 is an enlarged view of the winding holder in FIG. 2, FIG. 4 shows in perspective the rear of a number of yarn storage tubes of a yarn storage device according to the invention, with a winding holder in the position of rest and another winding holder in the winding-up position, FIG. 5 shows in perspective the front of the same yarn storage tubes as in FIG. 4, wherein the other ends of the same winding holders are also shown.

Figure 6:
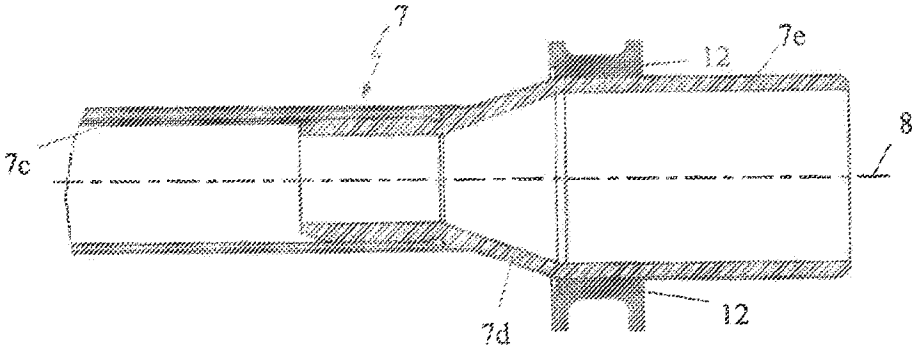
Figure 7B:
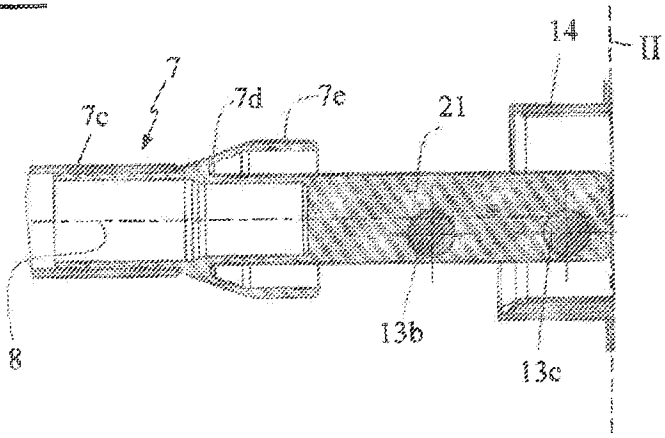
Figure 7A:
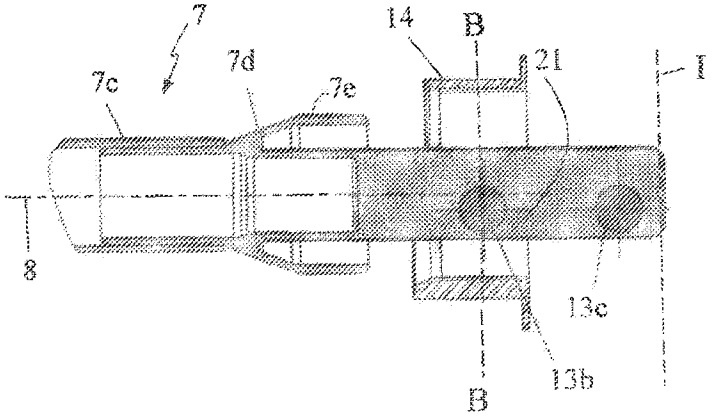
Figure 7C:
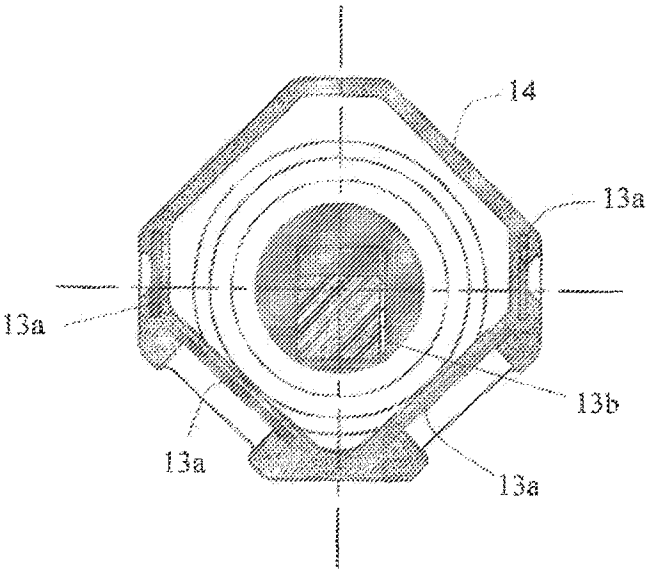
Figure 8:
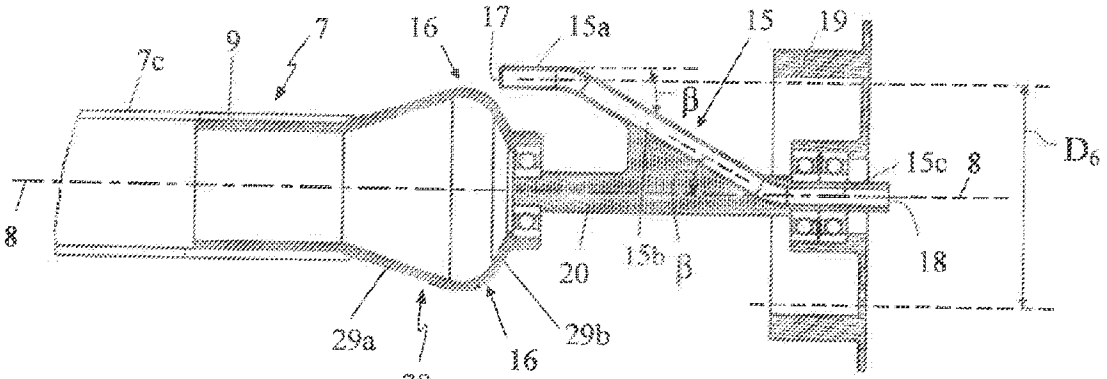
Figure 9B:
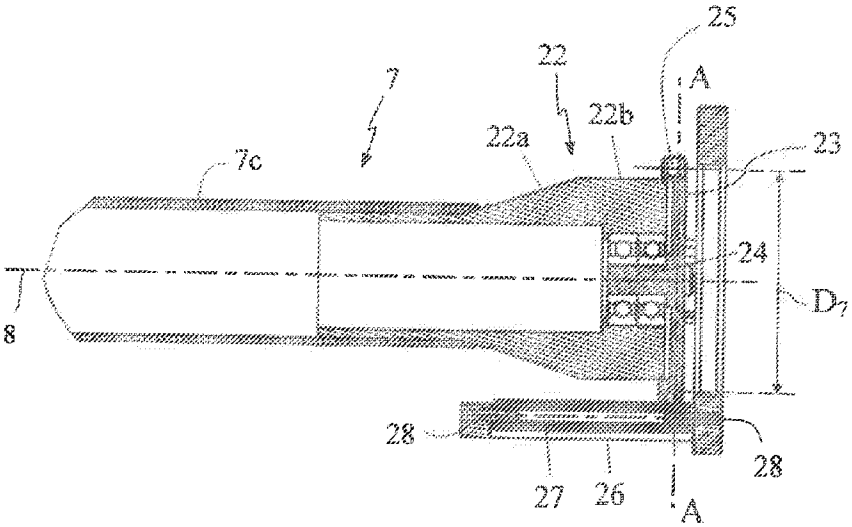
Figure 9A:
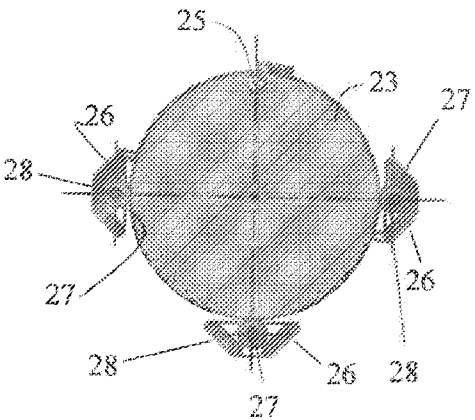

FIG. 6 shows a vertical cross-section of the front part of a winding holder supported by a brush element, FIGS. 7*a* and 7*b* show a vertical cross-section of the front part of a magnetically supported winding holder, in the position of rest and in the winding-up position, respectively, FIG. 7*c* shows a cross-section according to axis B-B of the winding holder in FIG. 7*a*, FIG. 8 shows a vertical cross-section of the front part of a winding holder and an associated yarn guide tube mounted on bearings, FIG. 9*a* shows a vertical cross-section of the front part of another embodiment of a winding holder with a rotatable and axially slidable disk with a yarn feed-through eye, and FIG. 9*b* shows a cross-section according to axis A-A of the winding holder in FIG. 9*a*.

The yarn storage device illustrated in FIG. 1 is used for supplying various yarns to a yarn processing machine, for example such as a weaving machine. This device is especially suitable for storing different yarns with unequal consumption in the yarn processing unit. The yarns provided in the yarn storage device are for example the pile yarns for a weaving machine for weaving pile fabrics.

For each different type or colour of yarn, an external yarn store is available, for example in the form of one or more colour bobbins with a large amount of that yarn. For the different yarns (yarn type and/or yarn colours), yarn stores are also continuously available in the respective yarn storage tubes (2). These stores are supplemented automatically, depending on yarn consumption, by means of one or more movable yarn loaders (3).

The number of yarn storage tubes corresponds substantially to the number of colours that one wishes to have available at a certain position viewed in the width in the fabric multiplied by the number of positions where one wishes to add the yarns in this way. For a machine for weaving pile fabrics, this number may normally correspond to the number of bobbin spindles that were traditionally provided for the pile yarns.

The yarn storage device (1) according to the invention shown in FIG. 1 comprises a frame (6), on which a number of hollow yarn storage tubes (2), of equal length with open ends and with an identical square cross-section, are grouped in several horizontal rows above one another into a substantially rectangular assembly. The various yarn storage tubes (2) are adjacent to each other or have common partition walls. Each yarn storage tube (see also FIGS. 4 and 5) has closed side walls that enclose an interior space (2*c*), and has a supply opening (2*b*) at the front end, via which the yarn store can be supplemented, and a discharge opening (2*a*) at the rear end, via which the yarn leaves the yarn storage tube (2) and is led to a yarn processing machine (not shown in the figures). Depending on yarn consumption, the yarn is withdrawn from the yarn store and moved to the yarn processing machine. The yarn storage tubes may be mounted slightly inclined, wherein the discharge opening (2*a*) is higher than the supply opening (2*b*). Preferably, however, they are mounted horizontally.

The open ends of these yarn storage tubes (2) lie in each case in one and the same vertical plane. On the side with the supply openings (2*b*), a yarn loader (3) is mounted on a platform that is movable in a vertical plane by an x-y motion system. The height position of the yarn loader (3) is determined by a first rack-and-pinion drive (4*a*) wherein the rack is connected to a vertical profile (4*b*) and the pinion is driven by means of an electric motor-reducer combination. The horizontal position of the whole, including the profile, is determined by means of a second rack-and-pinion drive (5*a*), wherein the rack is connected rigidly to a horizontal profile (5*b*) that forms part of the frame (6).

A winding holder (7) is provided in the interior space (2*c*) of each yarn storage tube (2). The winding holder (7) is an elongated and symmetrical whole that is supported centrally in the yarn storage tube, running along the longitudinal axis of the yarn storage tube (2). A winding holder (7) of this kind is shown in FIGS. 2 and 3.

The winding holder (7) comprises a winding-up part (7*a*) consisting of a base part (10) that carries a number of spaced-apart arms (11) that extend towards the end in the longitudinal direction of the winding holder (7). The arms (11) are provided on their ends, on the outer sides directed away from each other, with hook-shaped elements (11*a*). The yarn is wound on the arms (11) by the yarn loader (3), and the hook-shaped elements (11*a*) ensure that yarn cannot slip off of the arms (11). The arms define a winding-up surface with a diameter ($D_1$) of about 35 mm.

The winding-up part (7*a*) undergoes a transition via a conical intermediate part (7*b*) with a gradually decreasing diameter ($D_2$), into a long cylindrical part (7*c*)—the holder body (7*c*) that is provided in order to carry the supply of yarn in the form of windings that are wound round it. This holder body (7*c*) has a constant diameter ($D_3$) that is less than the diameter ($D_1$) of the winding-up part (7*a*). This diameter ($D_3$) of the holder body (7*c*) is about 25 mm. The yarn windings, which are formed on the winding-up part (7*a*) with a diameter of roughly 35 mm, are pushed along by the addition of new windings until they leave the winding-up part (7*a*) via the intermediate part (7*b*) and arrive on the holder body (7*c*). The yarn windings, with their original winding diameter of about 35 mm, thus end up on the holder body (7*c*) with a diameter of about 25 mm, so that they are located round holder body (7*c*) in a very loose state. The outer surface of the holder body (7*c*) forms a holder surface (9) for holding the yarn windings.

In the embodiment shown in FIGS. 2, 3, 6, 7*a* and 7*b*, there is transition of the other end of the holder body (7*c*) via a conical transition part (7*d*) into a cylindrical unwinding head (7*e*) with a diameter ($D_5$) that is greater than the diameter ($D_3$) of the holder body (7*c*). The diameter ($D_4$) of the conical transition part (7*d*) gradually increases towards the unwinding head (7*e*), from the left-hand end thereof, where the diameter ($D_4$) is equal to the diameter ($D_3$) of the holder body (7*c*) to the right-hand end thereof, where the diameter ($D_4$) is equal to the diameter ($D_5$) of the unwinding head (7*e*).

The surface of the transition part (7*d*) forms, relative to the surface (9) of the holder body (7*c*), an angle ($\alpha$) of about 20°, as indicated in FIG. 3.

As shown in FIGS. 4 and 5, each winding holder (7) can be placed in a position of rest (I) the position of the lower winding holder (7) in FIGS. 4 and 5—wherein the winding-up part (7*a*) is largely located in the interior space (2*c*) of the yarn storage tube (2), whereas the unwinding head (7*e*) is largely located outside the yarn storage tube (2), and each winding holder (7) can also be placed in a winding-up position (II) the position of the upper winding holder (7) in FIGS. 4 and 5—wherein the winding-up part (7*a*) is largely located outside the interior space (2*c*) of the yarn storage tube (2), whereas the unwinding head (7*e*) is largely located within this interior space (2*c*). If the winding holder (7) is placed in the winding-up position (II), the yarn loader (3) can wind yarn on the winding-up part (7*a*), in a manner similar to that described in EP 2721204. During winding-up of yarn, supply of yarn to the yarn processing machine can continue without any problems.

In FIG. 6, it is shown how a winding holder (7) is supported at the level of the unwinding head (7*e*) because a brush element (12) surrounds the unwinding head (7*e*). The thin hairs of the brush are sufficient to support the winding holder (7) in an ideal operating position, and are also bent very easily through contact with the yarn that is being unwound, so that the yarn can easily be pulled past the brush, since this only requires a very small unwinding pulling force. The brush element (12) can be supported at the level of the discharge opening by the sidewalls of the yarn storage tube (2).

Support may also be contactless (see FIGS. 7*a*, 7*b* and 7*c*), by providing the structures (14), which in the vicinity of the unwinding head (7*e*) are for example fastened to the side walls of the yarn storage tube (2), with first magnets (13*a*), and providing the unwinding head (7*e*) with an elongated cylindrical supporting part (21) extending along the longitudinal axis (8) with respective second magnets (13*b*), (13*c*) in two places apart from one another in the longitudinal direction, wherein the first magnets (13*a*) and the second magnets (13*b*), (13*c*) have mutually repulsive poles. The magnetic forces ensure that the winding holder (7) is held in the ideal operating position at the level of the unwinding head (7*e*). The winding holder (7) is as it were held in a floating position.

Because the winding head (7*e*) must be adequately supported both in the position of rest (I) the position in FIG. 7*a* and in the winding-up position (II) the position in FIG. 7*b*, second magnets (13*b*), (13*c*) are provided in two different places on the supporting part (21) of the unwinding head (7*e*).

To guide the yarn on its unwinding path, a guide tube (15) may also be provided, as shown in FIG. 8. The winding holder (7) does not comprise in this case an unwinding head as in the embodiments described above according to FIGS. 2 and 3, but the holder body (7*c*) has a transition at the end into a transition part (29) with a symmetrical shape and a first part (29*a*), the diameter of which is at first roughly equal to the diameter of the holder body (7*c*), and then gradually increases to a maximum diameter. At the point where the transition part (29) reaches its maximum diameter, it undergoes transition via a rounding (16) to a second part (29*b*)

with gradually decreasing diameter. The yarn is led past the transition part (29) directly via the guide tube (15) to the yarn processing machine.

The guide tube (15) has a horizontal initial part (15*a*), the open end of which forms the inlet (17). This inlet (17) is located above said rounding (16) of the transition part (29). The initial part (15*a*) starts from the transition part (29) and then, via a downward bend that makes an angle (β) of about 20°, transitions into a downward slanting straight portion (15*b*) and finally, via a bend which again makes an angle (β) of about 20°, transitions into a horizontal end part (15*c*) that extends along a longitudinal axis that coincides with the extension of the longitudinal axis (8) of the winding holder (7). The open end of the horizontal end part (15*c*) forms the outlet (18) of the guide tube (15).

The yarn runs from the winding holder (7) over the transition part (29) to the inlet (17) of the guide tube (15) and is led away from the holder surface (9). The yarn leaves the guide tube (15) via the outlet (18) and is led further to the yarn processing machine.

The tubular element (15) is fixed on a rotatable shaft (20) that is mounted on bearings at the level of the end of the transition part (29) and at the level of a rigidly mounted component (19), for example connected to the yarn storage tube. This rotatable shaft (20) extends along the longitudinal axis (8) of the winding holder (7). Due to the unwinding pulling force exerted on the yarn, the guide tube (15) and the shaft (20) can be caused to rotate, wherein the inlet (17) of the guide tube (15) describes a turning circle with a diameter ($D_6$) as indicated in FIG. 8.

To allow the winding holder (7) to slide between the position of rest (I) and the winding-up position (II), the mounting of the guide tube (15) is movable axially at the level of the rigidly mounted component (19), for example using a plain bearing or a needle bush, or by providing an axially slidable connection.

The yarn that is unwound from the holder body (7*c*) via the transition part (29) and is supplied to the yarn processing machine has, after leaving the transition part (29), a smooth, gradually changing course through the tubular element (15), without abrupt transitions, so that high stress peaks are avoided.

A similar arrangement can be seen in FIGS. 9*a* and 9*b*. The holder body (7*c*) is again connected to a cylindrical transition part (22) with a first portion (22*a*), the diameter of which gradually increases from the end connected to the holder body (7*c*)—where the diameters of the holder body (7*c*) and the transition part (22) are almost identical —to the other end, and with a second portion (22*b*) connected to that other end, with a constant diameter that is roughly equal to the largest diameter of the first portion (22*a*).

Beyond the transition part (22), a substantially disk-shaped unwinding element (23) is provided on a shaft (24) that is mounted on bearings so that the unwinding element (23) is rotatable about an axis that coincides with the longitudinal axis (8) of the winding holder (7). The unwinding element (23) comprises a feed-through eye (25) for the yarn in the vicinity of its peripheral edge.

The yarn is moved past the transition part (22) via the feed-through eye (25) to the yarn processing machine. Due to the unwinding pulling force exerted on the yarn, the unwinding element (23) will rotate about the axis (8), wherein the yarn in the feed-through eye (25) describes a turning circle with a diameter ($D_7$) as indicated in FIG. 9*b*.

In the yarn storage tube (2), elongated cylindrical guide rollers (27) are provided in respective elongated holders (26), so that the guide rollers (27) are in contact, at different locations distributed over the perimeter of the unwinding element (23), with the outer surface of the unwinding element (23), and wherein these locations are distributed in such a way that seen on a cross-section of the unwinding element (23) as in FIG. 9*a* two diametrically opposite locations lie on a first centre line of the circular cross-section of the unwinding element (23), and the third location lies on a second centre line that is perpendicular to the first centre line.

The guide rollers (27) extend in the longitudinal direction (8) of the yarn storage tube (2) and the winding holder (7) and are for example fixed to the walls of the yarn storage tube (2). The guide rollers (27) are connected at both ends by means of a small shaft (28) to their respective holder (26), so that the guide rollers (27) are rotatable about their longitudinal axis. Because the unwinding element (23) is in contact with the rotatable guide rollers (27), the unwinding element (23) can rotate more easily about the axis (8). When there is an axial movement of the winding holder (7), the unwinding element (23) slides over the elongated guide rollers (27). As a result, the winding holder (7) is movable axially between a position of rest (I) wherein the winding-up part (7*a*) is largely located in the interior space (2*c*) of the yarn storage tube (2) and a winding-up position (II) wherein the winding-up part (7*a*) is largely located outside the interior space (2*c*) of the yarn storage tube (2). In both positions, the transition part (22) and the unwinding element (23) are located within this interior space (2*c*).

In the embodiments presented in FIGS. 6, 7*a* and 7*b* and FIGS. 9*a* and 9*b*, after leaving the unwinding head (7*e*) or the unwinding element (23) the yarn preferably follows the same path as in the embodiment according to FIG. 8. For this, the yarn is preferably led in the direction of a point that is some distance from the unwinding head (7*e*) or the unwinding element (23) and lies in the vicinity of the extension of the longitudinal axis (8) of the winding holder (7), preferably lies on the extension of this longitudinal axis (8), and wherein the yarn is led in such a way that, after leaving the unwinding head (7*e*) or the unwinding element (23), the yarn has a smooth, gradually changing course on its path to said point. A guide eye, for example, may be positioned at said point.

In some yarn processing machines that are provided, for yarn supply, with a yarn storage device according to the present invention, it may be very advantageous to provide additionally a yarn tension system, wherein the yarn to be supplied is given a certain tension profile, wherein this may or may not be done individually per yarn. A yarn tension system of this kind is for example a system as described in WO 2017/077454 A1.

It may moreover also be very advantageous to combine the yarn storage device according to the present invention with a yarn feeding device, which is provided in order to determine, during weaving, the amount of yarn supplied, in particular the amount of pile yarn supplied, wherein the yarn supply per yarn can be determined individually or for several yarns together.

The invention claimed is:

1. Yarn storage device for a yarn processing machine comprising at least two storage units that are provided in order to hold a respective yarn store for the yarn processing machine, and at least one loader that is provided in order to join an end of the yarn of a selected storage unit to an end of an external amount of yarn and to add yarn from the external amount of yarn to the yarn of the selected storage unit, wherein at least one storage unit comprises a winding holder with a holder body that is provided in order to keep the windings of a yarn store in a state wound round this holder body, wherein the loader is provided in order to add yarn from the external amount of yarn to the yarn of the selected storage unit in windings with a winding diameter that is greater than the radial dimensions of the holder body, such that the windings are held as successive windings placed one after another in the state wound round the holder body.

2. Yarn storage device for a yarn processing machine according to claim 1, wherein the holder body of at least one winding holder defines a holder surface for the windings, and in that the respective storage unit comprises at least one guider to lead the yarn away from the yarn store of the yarn storage unit during unwinding thereof from the holder surface.

3. Yarn storage device for a yarn processing machine according to claim 2, wherein the at least one guider is provided in order to unwind the yarn from the holder body with an unwinding diameter that is greater than the radial dimensions of the holder body.

4. Yarn storage device for a yarn processing machine according to claim 3, wherein the at least one guider comprises an unwinding head connected to the holder body, whose radial dimensions are greater than the radial dimensions of the holder body.

5. Yarn storage device for a yarn processing machine according to claim 3, wherein the at least one winding holder comprises a transition part with a first end abutted to the holder body whose radial dimensions are almost the same as the radial dimensions of the holder body, and a second end directed towards the at least one guider whose radial dimensions are almost the same as the unwinding diameter and in that the radial dimensions of the transition part gradually increase from the first end to the second end.

6. Yarn storage device for a yarn processing machine according to claim 5, wherein, seen in a vertical cross-section of the holder body, a first line that extends in the extension of the upper side of the transition part and a second line that extends in the extension of the upper side of the holder body enclose an angle that is not greater than 60°.

7. Yarn storage device for a yarn processing machine according to claim 1, wherein at least one storage unit comprises at least one guider that is provided in order to unwind the yarn from the holder body with an unwinding diameter that is greater than the radial dimensions of the holder body, and in that the ratio of the unwinding diameter to the winding diameter is between 0.99 and 2, inclusive.

8. Yarn storage device for a yarn processing machine according to claim 1, wherein at least one winding holder comprises a winding-up part connected to the holder body, in that the at least one loader is provided in order to add yarn from the external amount of yarn to the yarn of the selected storage unit by winding it onto the winding-up part of the respective winding holder, wherein the windings on the winding-up part are gradually moved towards the holder body, and in that the winding-up part has radial dimensions that are greater than the radial dimensions of the holder body.

9. Yarn storage device for a yarn processing machine according to claim 8, wherein the at least one winding holder is incorporated in a yarn storage space with a supply opening, and is movable between a position of rest wherein the winding-up part is largely located within the yarn storage space of the storage unit and a winding-up position wherein the winding holder extends via the supply opening to outside the yarn storage space and wherein the winding-up part is largely located outside the yarn storage space, and in that the yarn storage device is provided in order to bring the winding holder from a selected storage unit into the winding-up position.

10. Yarn storage device for a yarn processing machine according to claim 9, wherein at least one storage unit comprises at least one guider that is provided in order to unwind the yarn from the holder body, and comprises the winding holder that is incorporated in the yarn storage space with a discharge opening via which the yarn is displaced towards the yarn processing machine, and in that the winding holder extends in the position of rest via the discharge opening to outside the yarn storage space so that the at least one guider is located at least partially outside the yarn storage space.

11. Yarn storage device for a yarn processing machine according to claim 1, wherein at least one storage unit comprises one or more flexible and/or deformable and/or movable supporting elements that support the winding holder, and in that each supporting element is positioned so that at least some supporting elements come in contact with the yarn during unwinding of the yarn, and in that the supporting elements are bent and/or deformed and/or moved by the forces that the yarn exerts directly or indirectly thereon, and thereby allow the yarn to pass through.

12. Yarn storage device for a yarn processing machine according to claim 1, wherein at least one storage unit comprises one or more forcers that are provided in order to exert a contactless force on the winding holder, so that the winding holder is forced by this contactless force to a predetermined operating position.

13. Yarn storage device for a yarn processing machine according to claim 1, wherein at least one storage unit comprises at least one guider in order to lead the yarn away from the yarn store during unwinding thereof from the holder surface, and in that the winding holder and the at least one guider is supported by a common rotatable shaft.

14. Yarn processing machine provided with at least one yarn storage device which comprises at least two storage units that are provided in order to comprise a respective yarn store for the yarn processing machine, and the at least one loader is provided in order to join an end of the yarn from a selected storage unit to an end of an external amount of yarn and to add yarn from the external amount of yarn to the yarn from the selected storage unit, wherein each yarn storage device is a yarn storage device according to claim 1.

15. Yarn processing machine according to claim 14, wherein it is a weaving machine, a tufting machine, a knitting machine or a beaming machine.

16. Method for replenishing a yarn store for a yarn processing machine wherein at least two storage units are provided that comprise a respective yarn store for the yarn processing machine, and wherein a selected yarn store is supplemented by joining an end of said selected yarn store to an end of an external amount of yarn and to add yarn from the external yarn store to the selected yarn store, wherein in at least one storage unit, a winding holder with a holder body is provided, and in that a yarn store is held in a state wound round the holder body, and wherein yarn is added from the external amount of yarn to the yarn of the selected storage unit in windings with a winding diameter that is greater than the radial dimensions of the holder body, such that the windings are held as successive windings placed one after another in the state wound round the holder body.

17. Method for replenishing a yarn store for a yarn processing machine according to claim 16, wherein the holder body of the winding holder defines a winding surface for the windings, and in that the yarn from each yarn store is led away from the winding surface during unwinding thereof.

18. Method for replenishing a yarn store for a yarn processing machine according to claim 16, wherein at least one winding holder comprises a winding-up part connected to the holder body, with radial dimensions that are greater than the radial dimensions of the holder body, and in that the external amount of yarn is added to the yarn of a selected storage unit by winding it onto the winding-up part of the respective winding holder and wherein the windings are then moved to the holder body.

19. Method for replenishing a yarn store for a yarn processing machine according to claim 16, wherein at least one winding holder defines a holder surface for the windings and in that the respective storage unit comprises at least one guider for unwinding the yarn from the yarn store of the respective yarn storage unit with an unwinding diameter that is greater than the radial dimensions of the holder body, so that the yarn is led away from the holder surface during unwinding thereof.

20. Method for replenishing a yarn store for a yarn processing machine according to claim 16, wherein at least one storage unit comprises the winding holder that comprises an unwinding head connected to the holder body, wherein the unwinding head has radial dimensions that are greater than the radial dimensions of the holder body.

* * * * *